US005160802A

United States Patent [19]

Moscrip

[11] Patent Number: 5,160,802

[45] Date of Patent: Nov. 3, 1992

[54] PRESTRESSED COMPOSITE GUN TUBE

[75] Inventor: William M. Moscrip, King George County, Va.

[73] Assignee: The United States of America as represented by the Secretary of the Navy, Washington, D.C.

[21] Appl. No.: 616,970

[22] Filed: Sep. 24, 1975

[51] Int. Cl.[5] ..... F41A 21/02

[52] U.S. Cl. ..... 89/16; 29/1.11

[58] Field of Search ..... 29/1.1, 1.11; 42/76 A, 42/76.02; 75/170; 89/16

[56] References Cited

U.S. PATENT DOCUMENTS 3,174,851 3/1965 Buehler et al. ..... 75/170

3,832,243 8/1974 Donkersloot et al. ..... 75/170

*Primary Examiner*—Stephen C. Bentley

*Attorney, Agent, or Firm*—Kenneth E. Walden

[57] ABSTRACT

A composite gun tube having a liner prestressed in compression by a surrounding cylinder formed of an appropriate Nitinol alloy. A first alternative construction utilizes Nitinol in filamentary form wrapped around the liner. A second alternative construction utilizes filamentary Nitinol embedded in the liner material. In all cases, the Nitinol is formulated so that the critical transition temperature is below that of any environment which the gun tube might encounter.

12 Claims, 1 Drawing Sheet

PRESTRESSED COMPOSITE GUN TUBE

BACKGROUND OF THE INVENTION

This invention relates to gun tubes and more particularly to light weight, high strength, high stiffness composite gun tubes having prestressed liners exhibiting greatly improved resistance to the erosive effects of high temperature propellant combustion products.

Gun tubes are pressure vessels that must be made of high strength materials in order to reliably contain very high internal propellant gas pressures, often under adverse conditions simultaneously imposed by the extremely hot and highly corrosive nature of the gaseous combustion products present. In order to hold gun tube wall thickness within reasonable limits so that maximum system weight requirements are not exceeded, various construction techniques have been developed to impart a residual state of compressive stress to the interior portion of the tube. Such compressive stresses cancel in part the large tensile stresses induced by the propellant gas pressure upon firing and thereby reduce the total material wall thickness required for the tube to withstand a given maximum firing pressure.

Three common techniques currently or formerly employed for prestressing gun tubes during fabrication are (1) wire-wrapping under tension, (2) shrink fit assembly of two or more concentric tubes, and (3) autofrettage or self-hooping. The first of these involves the radial wrapping of a central tube or liner with high tensile strength wire, usually square in cross section, while maintaining a uniform tension on the wire and thereby inducing an initial compressive stress in the tube. However, the tendency of wire-wrapped composite tubes to droop and whip excessively has resulted in the general replacement of this type of construction by the shrink-fit assembly method.

The shrink-fit method of composite gun tube construction involves the thermal expansion of one cylindrical tube by heating, the insertion of a second tube concentrically within the first, and then the achievement of a precisely determined interference fit when the heated cylinder is allowed to cool and shrink back toward its original diameter. This procedure results in a jacketed or layered gun tube consisting of two or more concentric cylinders, the total wall thickness of which is less than a non-prestressed monobloc tube of the same strength.

The difficulty and limitation inherent in the method of shrink-fit construction derives from the necessarily small clearance between the heated tube and the cool liner which can be obtained via thermal expansion to produce a given interference fit. During the assembly process this clearance tends to disappear as the liner is inserted because the heat transfer between the two components is usually rapid. Therefore the available insertion time is correspondingly short and long or massive tubes are difficult to assemble.

Autofrettage or self-hooping is a method for prestressing thickwalled steel cylinders which is now the primary method of gun tube manufacture. It involves the technique of stressing the inner portion of the wall beyond the elastic region while at the same time not exceeding the yield point on the outer surface of the tube. When the stress inducing agent, either hydrostatic pressure or an oversized mandrel, is removed, the outer portion of the tube will contract in an effort to recover its original size. The contraction compresses the inner wall of the tube and induces substantial permanent compressive stresses in this region. Prestressed in this manner the tube is safe for any pressure which does not exceed the autofrettage pressure or its equivalent, but the method is generally limited to the manufacture of thick wall steel monobloc gun tubes.

SUMMARY OF THE INVENTION

The present invention is a set of prestressed composite gun tubes and methods for construction of such gun tubes which utilize the unique physical and mechanical properties of nickel-titanium and nickel-titanium-cobalt alloys, known as Nitinol alloys, to achieve a high degree of prestress within interior regions of a composite tube, thereby reducing the size and weight of the tube required to adequately contain a given pressure. This new technique permits the use of normally brittle refractory materials, such as aluminum oxide and boron nitride, to be used as liner materials in such gun tubes, resulting in light weight, high strength, high stiffness, and greatly improved resistance to the erosive effects of high temperature propellant combustion products. Further, it permits the application of advanced composite materials design techniques, in the placement of filaments within a matrix to achieve tailored properties in specific directions within the total structure.

DESCRIPTION OF THE PREFERRED EMBODIMENTS

This invention utilizes certain unique properties of Nitinol alloys to achieve high order prestress in the construction of composite gun tubes, by means of processes which superficially incorporate some aspects of each of the three conventional prestress methods previously described. The Nitinol alloys were developed at the U.S. Naval Ordnance Laboratory during the 1960's. The basic Nitinol alloys are described in U.S. Pat. No. 3,174,851. They are nickel-titanium alloys based upon the ductile intermetallic compound TiNi. Nominal 55-Nitinol (55% nickel, 45% titanium by weight) is nearly stoichiometric TiNi, with a density of 0.22304 pounds per cubic inch and a melting point of 1310° C. At room temperature 55-Nitinol has an ultimate tensile strength of 125,000 psi and a modulus of elasticity of $10.2\times10^6$ psi, and with proper heat-treatment, tensile strengths as high as 180,000 psi are possible.

The Nitinol alloys, in addition to being single phase and ductile, exhibit a very unusual property in the form of a so-called "mechanical memory" which is a function of the temperature and strain history of the material. This "mechanical memory" property is attributed to a unique martensitic crystalline phase transformation which occurs across a critical transition temperature, designated $A_s$. This property enables the Nitinol alloys to recover a given shape after having been mechanically distorted at some temperature below $A_s$, by simply heating the material to some temperature above $A_s$.

For example, the critical transition temperature for nominal 55-Nitinol is approximately 60° C. Suppose a sample of this alloy has been cast in the shape of a coffee cup; if we then distort the cup at room temperature (below 60° C.) by striking it with a hammer, it will revert to its original shape when immersed in boiling water. Four technical facts related to this unique property are particularly relevant to this invention and are stated as follows:

1. The amount of strain which can be applied and still result in complete shape recovery is limited but samples distorted up to 8% have been found to recover with nearly 100% efficiency.

2. When a deformed sample is constrained from returning to its original shape when heated above $A_s$, it has been shown that up 110,000 psi of force can be exerted by the material in the effort.

3. If cobalt is added to the alloy in accordance with the ternary formulation $TiNi_xCo_{1-x}$, as taught by U.S. Pat. No. 3,558,369, it is possible to vary the critical transition temperature within a range of approximately −238° C. to +166° C.

4. The tensile strength of Nitinol alloys can be increased by heat treatment to achieve the formation of an intermetallic phase of $Ti_2Ni_3$, a precipitation hardening mechanism.

Figure 1:
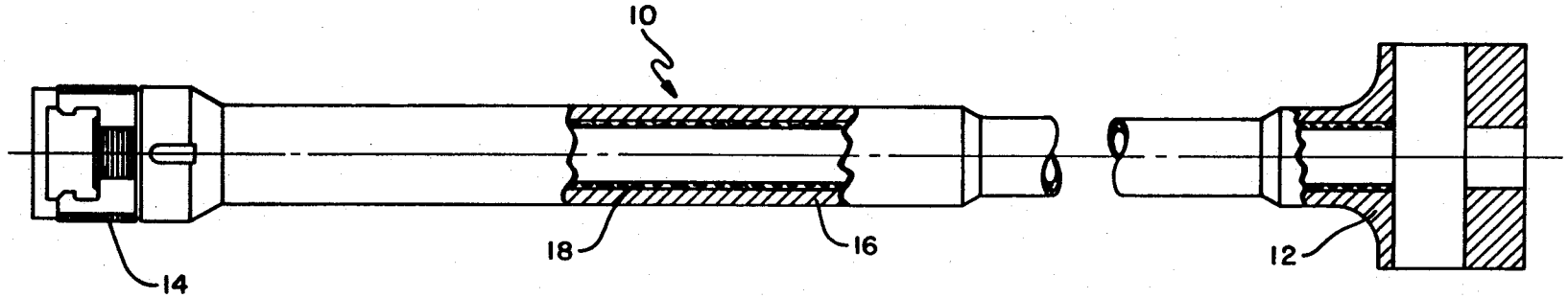
FIG. 1 is a longitudinal section through a composite gun tube constructed in accordance with a first embodiment of the invention.

Referring now to FIG. 1 there can be seen a gun tube, designated generally by the reference numeral 10, having a flash suppressor 12 on the muzzle and the customary interrupted thread arrangement 14 on the breech end for securing the breech block (not shown). The gun tube 10 is a composite tube formed of an outer tube 16 and a concentric inner tube or liner 18.

One procedure for the construction of the composite gun tube 10 utilizing the properties of the Nitinol alloys can be described as follows. First the outer cylindrical tube 16 is manufactured from an appropriate Nitinol alloy in accordance with the teachings of U.S. Pat. No. 3,558,369 having the structural formula $TiNi_xCo_{1-x}$ with x selected to provide a critical transition temperature below the lowest temperature expected to be encountered in service use (e.g. −60° C.). The inside diameter of the Nitinol tube 16 is initially made about 8% smaller than the outside diameter of the liner 18 which is manufactured from suitable gun tube liner material, e.g. aluminum oxide, boron nitride, other ceramic or cermet materials or appropriate steel alloys.

Both cylinders are then placed in a cold room and chilled to some temperature less than −60° C. Under these conditions the Nitinol cylinder 16 is expanded or stretched with an oversize mandrel (in a manner similar to the swaging autofrettage process) to a diameter slightly larger than that of the liner 18. The liner can then be placed concentrically within the Nitinol cylinder as accurately as required, and taking whatever time is desired to easily complete the operation. When this assembly is subsequently removed from the cold room and is permitted to warm to room temperature, the Nitinol cylinder will attempt to regain its original configuration. However, as it will be constrained from doing so by the presence of the liner tube, a considerable force can be exerted on the liner to place it in a state of compressive stress. The net result is similar to that achieved by the shrink fit assembly method but is potentially more effective, less difficult to accomplish, and more easily controlled.

There are two principle alternatives to the process described above which contain the essential features of the invention but involve a significantly different technical approach. Both of these are characterized by the utilization of Nitinol alloy in the form of high-strength wire filaments instead of a cylindrical tube to achieve high-order prestress.

Preliminary to either alternative process, a quantity of Nitinol alloy, again with $A_s$ equal to perhaps −60° C., is drawn into wire and heat-treated to obtain maximum strength and elastic modulus properties consistent with the "mechanical memory" property. Then the wire is placed in a cold room and, after cooling to some temperature below $A_s$, it is drawn through a die designed to stretch the wire to the required 8% optimum deformation.

The first alternative process involves a wire-wrapping technique similar to the conventional method described, except that now part or all of the tensile forces to be applied to the liner would occur after the wrapping operation is completed and the assembly is returned to room temperature. In addition, the wire could be implanted within a plastic or metal matrix and the wrap-angle changed as required to achieve desired strength, modulus, and prestress characteristics in specific directions in accordance with the precepts of advanced filament-wound composite material technology.

For example, the high-strength Nitinol wire might be coated with aluminum (or titanium, etc.) prior to the cold drawing operation. After the wrapping operation the filaments would be consolidated by pressure and temperature to achieve a Nitinol filament reinforced aluminum matrix composite outer tube surrounding and precompressing the ceramic liner. The end result would be an advanced multi-composite gun tube with optimum strength, stiffness, prestress, and other structural properties precisely tailored to withstand the gun tube environment.

Figure 2:
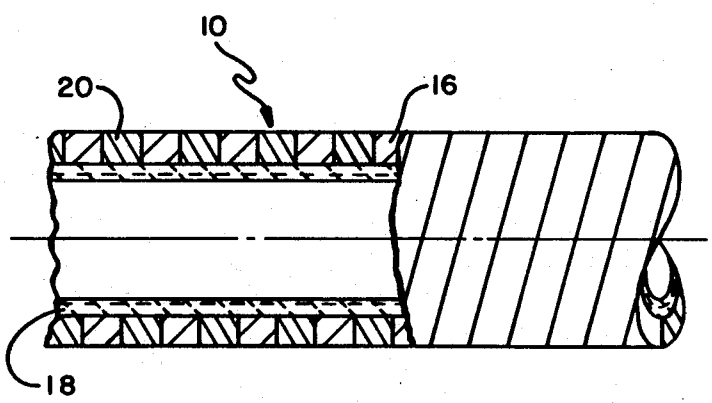
FIG. 2 is a fragmentary sectional view similar to FIG. 1 showing a portion of a composite gun tube constructed in accordance with a second embodiment of the invention.

FIG. 2 illustrates a gun tube made in accordance with the first alternative process. The outer tube 16 is formed of Nitinol wire 20 of square cross-section encompassing the liner 18.

The second alternative process is a further extension of the others which involves the placement of the cold-worked Nitinol wire filaments directly within the ceramic liner to form a monobloc metal reinforced ceramic composite gun tube with preferred levels of prestress in specific directions within specific layers of the structure, once again precisely tailored to meet a given complex load requirement. The fabrication of such structures is achieved in a process wherein the Nitinol filaments are drawn through a die which is in direct contact with a cryogenic fluid (e.g. liquid air) and immediately wrapped about a mandrel while the ceramic matrix is simultaneously applied via a conventional plasma spray technique. The resulting composite liner is then automatically prestressed when the Nitinol filaments are brought above the critical transition temperature as before.

Figure 3:
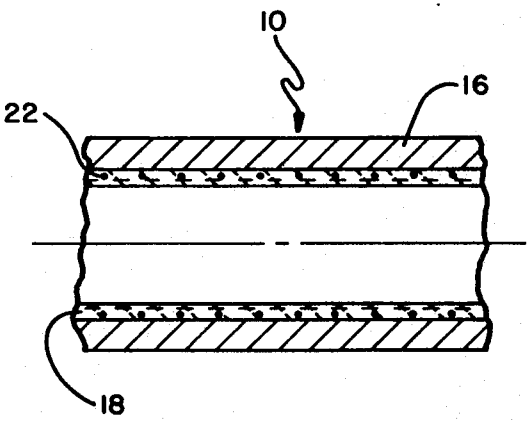
FIG. 3 is a view similar to FIG. 2 illustrating a third embodiment of the invention.

FIG. 3 illustrates a gun tube made in accordance with the second alternative process. The inner tube or liner 18 has Nitinol reinforcing filaments 22 disposed therein.

From the foregoing it will be readily apparent that the present invention posses numerous advantages not found in the prior art. For example:

1. High structural efficiency is achieved through the application of the high order prestress derived from the "mechanical memory" effect of Nitinol alloys.

2. High specific strength is achieved since Nitinol alloys are up to 20% lighter than gun steel and candidate liner materials are also comparatively lightweight.

3. Practical utilization of brittle materials such as aluminum oxide, boron nitride, or other ceramic/cermet materials as gun tube liners is now possible to provide the highest degree of propellant gas erosion resistance at the bore surface. Such materials are not presently feasible in this application because they lack fracture toughness; if placed in permanent compression, however, so that the material would not see a tensile load even during the peak internal pressure loading, typical brittle fracture modes would be effectively precluded.

4. Ease of manufacture due to the nature of the processes described and the fact that ceramic liner structures can be made by powder consolidation techniques (press-and-sinter or hot-press). Incorporation of rifling grooves by such methods, for example, would be a simple process compared to conventional machining techniques.

5. High resistance to corrosion in a marine environment (without painting) and superior fatique strength, both inherent physical properties of the Nitinol alloys.

Obviously many other modifications an variations of the present invention will occur to those skilled in the art in the light of the above teachings. It is therefore to be understood that within the scope of the appended claims the invention may be practiced otherwise than as specifically described.

What is claimed is:

1. A prestressed composite gun tube comprising:

an inner liner tube; and an outer tube of Nitinol alloy encompassing said liner and having a critical transition temperature lower than any temperature the gun tube might experience in its operating environment, said outer tube having been expanded from an initial inner diameter smaller than the outer diameter of said liner while at a temperature below its critical transition temperature whereby said liner is prestressed in compression when the composite tube is at any temperature above the critical transition temperature of the Nitinol alloy.

2. A gun tube as defined in claim 1 wherein said outer tube of Nitinol alloy is of monobloc construction.

3. A gun tube as defined in claim 1 wherein said outer tube of Nitinol alloy is formed of Nitinol wire wound around said liner, said Nitinol wire having been stretched while at a temperature below its critical transition temperature prior to winding.

4. A gun tube as defined in claim 1 wherein said liner tube is formed of aluminum oxide.

5. A gun tube as defined in claim 1 wherein said liner tube is formed of boron nitride.

6. A gun tube as defined in claim 1 wherein said liner tube is formed of a cermet material.

7. A gun tube as defined in claim 4 wherein a stretched Nitinol alloy filament is embedded within said liner tube to provide an initial compressive prestress of said liner tube.

8. A gun tube as defined in claim 5 wherein a stretched Nitinol alloy filament is embedded within said liner tube to provide an initial compressive prestress of said liner tube.

9. A method of making a prestressed composite gun tube comprising the steps of:

forming an inner liner tube;

forming an outer tube of Nitinol alloy having a critical transition temperature lower than any temperature the gun tube might experience in its operating environment and having an initial inner diameter smaller than the outer diameter of said inner liner;

cooling said outer tube to a temperature below its critical transition temperature;

stretching said outer tube to effectively increase its inner diameter;

disposing said inner liner within said outer tube; and allowing the temperature of said outer tube to rise above its critical transition temperature whereby said inner liner will be prestressed in compression.

10. A method as defined in claim 9 wherein the outer tube is of monobloc construction and the step of stretching is accomplished by expanding the outer tube on an oversize mandrel.

11. A method as defined in claim 9 wherein the step of forming the inner liner includes the additional step of disposing a prestretched Nitinol alloy filament within said inner liner as said inner liner is being formed to provide an initial compressive prestress of said liner.

12. A method as defined in claim 9 wherein the step of forming the outer tube is accomplished by winding a Nitinol alloy wire around said inner liner, said wire having been previously stretched by cold drawing while at a temperature below its critical transition temperature.

* * * * *